United States Patent [19]

McManis, III et al.

[11] Patent Number: 4,624,754

[45] Date of Patent: Nov. 25, 1986

[54] IONIC LIQUID COMPOSITIONS FOR ELECTRODEPOSITION

[76] Inventors: George E. McManis, III, 1013 Sherri; Aaron N. Fletcher, P.O. Box 1314; Dan E. Bliss, P.O. Box 1999, all of Ridgecrest, Calif. 93555

[21] Appl. No.: 741,340

[22] Filed: Jun. 5, 1985

[51] Int. Cl.[4] ..... C25D 3/44

[52] U.S. Cl. ..... 204/58.5

[58] Field of Search ..... 204/58.5, 39

[56] References Cited

U.S. PATENT DOCUMENTS 3,131,134 4/1964 Micillo ..... 204/14

3,547,818 12/1970 Wade ..... 204/58.5

3,616,279 10/1971 Kendall ..... 204/14 N 3,616,280 10/1971 Arnold ..... 204/58.5

3,790,450 2/1974 Bloch et al. ..... 204/14 N

OTHER PUBLICATIONS

L. Audrieth and J. Kleinberg, *Non-Aqueous Solvents,* 143–146 (John Wiley & Sons, Inc., 2d ed., 1953).

*Primary Examiner*—T. M. Tufariello

*Attorney, Agent, or Firm*—W. Thom Skeer

[57] ABSTRACT

An ionic liquid composition for the electrode position of metals and more particularly to compositions using non-aqueous organic electrolytic solutions.

10 Claims, No Drawings

IONIC LIQUID COMPOSITIONS FOR ELECTRODEPOSITION

BACKGROUND OF THE INVENTION

1. Field of the Invention

This invention relates to the electrodeposition of metals and more particularly to compositions using non-aqueous organic electrolytic solutions for the electrodeposition of metals. More specifically, the present invention provides a process for the preparation of ionic liquids, the compositions of the ionic liquids and methods for the deposition of such metals as Fe, Ni, Zn, Ag, Pb, Cu and the like from room temperature ionic liquid melts.

In another aspect of the invention it relates to a method for the electrodeposition of metals of the class above prescribed in which the utility of nitrate-amide ionic liquid melts as room temperature electrolytic solutions is demonstrated.

2. Description of the Prior Art

It has been shown in the prior art that electrochemical plating or electrocoating has been performed in various types of electrochemical cells where the electrically conductive objects are passed through an aqueous coating bath in which organic materials are dispersed and a direct current flow of electrical energy is maintained by a differentiation of electrical potential between the negative cathode and the positive anode. The prior art has also reported the anodization of several metals including titanium in a $NH_4NO_3$-urea eutectic melt between 45° C. and 85° C. as well as the effects of amides on electrode reactions in molten nitrates at higher temperatures. However, the present invention appears to be the first disclosure of the preparation, use and electrochemistry of nitrate-amide melts at room temperature.

SUMMARY OF THE INVENTION

In contradistinction to the prior art, the present invention is concerned with a method of depositing a metal coating upon a substrate utilizing a non-aqueous ionic melt comprising a solvent which is composed of one or more amides or imides, an electrolyte that contains one or more nitrate salts and an anhydrous metal nitrate or metal halide. The preparation of the ionic liquids utilized in the electrodeposition of the aforementioned metals is also disclosed.

OBJECTS OF THE INVENTION

It is therefore an object of this invention to prepare a non-aqueous ionic liquid melt comprising a solvent which is composed of one or more amides or imides, an electrolyte that contains one or more nitrte salts and an anhydrous metal nitrate or metal halide.

A further object of this invention is a method for depositing a metallic coating upon a substrate utilizing a novel ionic liquid.

It is yet another object of this invention to utilize a method for the electrodeposition of metals utilizing nitrate-amide melts as room temperature ionic liquids.

DETAILED DESCRIPTION OF THE INVENTION

One embodiment of this invention is a method for electrochemically coating a substrate utilized as the positive electrode of an electrochemical cell. A direct current flow of electrical energy is maintained throughout the electrolyte where a difference of electrical potential of the first electrode to that of the second electrode is provided to insure a direct current flow of electrical energy for a predetermined period of time sufficient to form a coating on said substrate by utilizing a non-aqueous ionic liquid melt at room temperature. The ionic liquid consists of a solvent which includes one or more amides or imides. The liquid also contains an electrolyte consisting of one or more nitrate salts and an anhydrous metal nitrate or metal halide of the transition metal series.

Another embodiment of this invention is the uniform thin deposition of several metals onto a substrate from an ambient temperature ionic liquid melt. The metals may be deposited on a variety of conductive substrates including but not limited to metals such as platinum, gold, nickel, copper, stainless steel, lead, cadmium and silver, graphite, pyrolytic graphite and vitreous carbon or conductive polymer substrates. All of the metals may be deposited free of an oxide layer when the ionic liquid is deoxygenated. Further, the form of the metal used in the deposition process may be either the metal halide or metal nitrate.

As indicated previously the present invention is concerned with a method for electrocoating a substrate utilizing a novel ionic liquid melt which consist of or comprises a solvent composed of one or more amides or imides or mixtures thereof selected from the group consisting of acetamide, urea, methyl formamide, dimethyl urea, propionamide, benzamide, succinimide, maleimide, pthalimide, pthalimide derivatives such as N-methyl pthalimide and N-ethyl pthalimide, and mixtures thereof, an electrolyte comprising one or more nitrate salts including but not limited to the group consisting of $LiNO_3$, $NaNO_3$, $KNO_3$, $NH_4NO_3$ and mixtures thereof, and an anhydrous metal nitrate such as lead nitrate and cadmium nitrate or a metal halide. The electrodeposition of the substrate utilizing the ionic liquid melt composition is effected at room temperature, 23° C. The period of electrolysis time to effectuate the electrocoating of the substrate is dependent upon the thickness of coating desired and the current that is passed through the electrochemical cell. The requisite time necessary to complete the electrodeposition will usually range from about five minutes to about an hour in order to obtain the desired thickness when using an initial electromotive force slightly more negative than the reversible potential of the metal couple being reduced.

The method of depositing an inorganic metal coating onto a substrate according to the invention may be carried out in either a batch or continuous type operation. For example, when a batch type operation is employed, the electrochemical cell utilizes the metal that is to be coated as the cathode while the second electrode terminal is utilized as the anode. The prepared ionic liquid melt or ionic liquid is placed in an electrochemical cell of conventional design using working electrodes sealed in either glass, teflon, or epoxy so that the positive and negative electrodes are submerged beneath the surface of the ionic liquid. A direct current flow is emitted to the cell and maintained by a differential of electrical potential between the first electrode and the second electrode for a predetermined period of time sufficient to deposit the desired metal upon the cathode substrate at ambient temperature.

It is also within the contemplation of this invention that a continuous type of operation may be employed to effect the electrocoating of the substrate. When such an operation is employed, the electrolyte must be continually replenished in the cell in order to maintain a proper level above the bottom of the electrodes. The cathode substrate must also be periodically removed from the operation at the point of desired thickness of the metal coating to prevent overcoating.

The following examples are given to illustrate the invention but are not intended to limit the generally broad scope thereof. The chemicals utilized were reagent grade or of higher purity. Ammonium nitrate was dried under vacuum at 120° C. to about 150° C. for several days before use. Acetamide was dried under vacuum at pressure less than 1 torr, over $P_2O_5$ for several days prior to use. Nickel (II) chloride and copper (II) chloride were dried under vacuum at 120° C. to about 150° C. Anhydrous $FeCl_3$, $Pb(NO_3)_2$ and $Cd(NO_3)_2$ were reagent grade and used as received.

All ionic liquid melts were prepared, stored, and handled in an atmosphere of flowing air that had been dried to less than 0.5% relative humidity. Each melt was prepared by fusing the components with occasional agitation in a sealed vessel such as a pyrex vessel at about 120° C. for a time sufficient to cause the acetamide to fuse, usually about 15 minutes. By containing the ionic liquid mixture in a sealed vessel the acetamide is forced to remain in solution and cannot vaporize out of the melt. Once the mixture was completely liquid, the melt was cooled to room temperature in an atmosphere of dry air. Karl Fischer analysis of the product prepared in this manner showed a normal water content less about 0.05 weight percent $H_2O$. Metal ion solutions in the ammonium nitrate-amide melts were prepared by fusing the metal halide with the nitrate and the amides at about 120° C. in a sealed pyrex vessel.

EXAMPLE 1

In this example a standard electrochemical cell was utilized. The electrolyte added to the electrochemical cell was prepared by fusing together 0.01 mole fraction (hereinafter mf) $FeCl_3$, 0.19 mf $NH_4NO_3$, 0.48 mf $CH_3CONH_2$, and 0.32 mf $(H_2N)_2CO$ in a sealed pyrex vessel at 120° C. with occasional agitation. This melt was allowed to cool to ambient temperature prior to introduction into the electrochemical cell. Electrolysis was carried out at ca. 10 $mAcm^{-2}$ for several hours resulting in the deposition of an iron metal onto the Pt cathode. The thickness of the deposition may be tailored depending upon the time and current density during electrolysis.

EXAMPLE 2

The electrolysis of this example is the same as in Example 1 except that 0.1 mf $LiNO_3$ are substituted for 0.19 mf of $NH_4NO_3$. This allows lower rate/current deposition with less acidity of the electrolytic mixture and lower corrosion rates.

EXAMPLE 3

The electrolyte utilized in the electrolysis of this example is the same as in Example 2 except that 0.01 ml $CuCl_2$ was substituted for 0.01 mf $FeCl_3$ resulting in the deposition of Cu onto the cathode.

EXAMPLE 4

In this example, the electrolyte composition was the same as in Example 2 except that 0.01 mf $Pb(NO_3)_2$ was substituted for 0.01 mf $FeCl_3$ resulting in the deposition of Pb onto the cathode.

EXAMPLE 5

The electrolyte used in this example is the same as in Example 3. However, during electrolysis the potential is held constant at slightly negative of the equilibrium potential of the metal/metal ion couple. The greater the potential is displaced from the equilibrium the faster the metal is deposited on the substrate. In addition, small displacements yield higher and more pure deposits than either the constant current or the potentiostatic electrolysis using large negative displacements from the equilibrium potential.

Obviously, many modifications and variations of the present invention are possible. It should be understood that, within the scope of the appended claims, the invention may be practiced otherwise than as specifically described.

What is claimed is:

1. A non-aqueous ionic liquid composition for use in the electrodeposition of a metal upon a conductive substrate at a room temperature of approximately 23° C. comprising a solvent, a nitrate salt electrolyte and an anhydrous metal salt.

2. An ionic liquid according to claim 1 wherein said solvent is an amide selected from the group consisting of acetamide, urea, methyl formamide, dimethyl urea, propionamide, benzamide and mixtures thereof.

3. An ionic liquid according to claim 1 wherein said solvent is an imide selected from the group consisting of succinimide, maleimide, pthalimide, pthalimide derivatives and mixtures thereof.

4. An ionic liquid according to claim 1 wherein said solvent is a mixture of amides and imides.

5. An ionic liquid according to claim 1 wherein said solvent is selected from the group consisting of acetamide, urea, methyl formamide, dimethyl urea, propionamide, benzamide, succinimide, maleimide, pthalimide, pthalimide derivatives and mixtures thereof.

6. An ionic liquid according to claim 1 wherein said electrolyte is selected from the group consisting of nitrate salts or mixtures thereof.

7. An ionic liquid according to claim 1 wherein said electrolyte is selected from the group consisting of $LiNO_3$, $NaNO_3$, $KNO_3$, $NH_4NO_3$ and mixtures thereof.

8. An ionic liquid according to claim 1 wherein said metal salt is selected from the group consisting of metal nitrates, metal halides and mixtures thereof.

9. An ionic liquid according to claim 1 wherein said metal salt is selected from the group consisting of the nitrates of lead, cadmium, zinc, copper, iron, nickel, and silver.

10. An ionic liquid according to claim 1 wherein said metal salt is selected from the group consisting of the chloride salts of iron, nickel, zinc, cadmium, and copper.

* * * * *